US005667602A

United States Patent [19]

Fang et al.

[11] Patent Number: 5,667,602

[45] Date of Patent: Sep. 16, 1997

[54] ALLOY FOR CAST COMPONENTS

[75] Inventors: Que-Tsang Fang, Export; Steven A. Jones, Murrysville; James R. Van Wert, Irwin, all of Pa.; Roger C. Dickenson, Roanoke, Va.

[73] Assignee: Aluminum Company of America, Pittsburgh, Pa.

[21] Appl. No.: 414,985

[22] Filed: Mar. 31, 1995

[51] Int. Cl.[6] ..... C22F 1/04

[52] U.S. Cl. ..... 148/549; 148/702; 148/415; 148/440; 420/543; 420/544

[58] Field of Search ..... 148/549, 698, 148/702, 415, 440; 420/542, 543, 544, 546, 547, 551, 553

[56] References Cited

U.S. PATENT DOCUMENTS 4,618,163 10/1986 Hasler et al. ..... 280/785
5,076,344 12/1991 Fields et al. ..... 164/457
5,250,125 10/1993 Koch et al. ..... 148/549

FOREIGN PATENT DOCUMENTS 625515 6/1949 United Kingdom ..... 420/546

*Primary Examiner*—George Wyszomierski
*Attorney, Agent, or Firm*—Thomas R. Trempus

[57] ABSTRACT

Alloy and cast alloy product ideally suited for use as a component in a vehicle frame or subframe, i.e., body-in-white, comprising an alloy consisting of about 2.00 to 5.00 wt. % magnesium, up to approximately 0.30 wt. % silicon, approximately 0.20 to 1.60 wt. % manganese, up to approximately 1.00 wt. % iron, and between about 0.10 to 0.30 wt. %, zirconium, the balance substantially aluminum and incidental elements and impurities. The aluminum/magnesium alloy is typically solidified into ingot derived working stock by continuous casting or semi-continuous casting into a shape suitable for remelt for casting, which shape is typically an ingot billet. Excellent mechanical properties are obtained from a cast product that is not subjected to high temperature heat treating operations subsequent to casting.

29 Claims, No Drawings

ALLOY FOR CAST COMPONENTS

This invention concerns aluminum casting alloys. Principally, the invention is an improved aluminum/magnesium casting alloy and a method of producing improved aluminum/magnesium alloy products by means of casting operations.

BACKGROUND

It is known to manufacture a vehicle frame by providing separate subassemblies, each subassembly being composed of several separate components. Each subassembly is manufactured by joining together several tube-type members with tube and socket joint or by means of a node structure that can be a cast component. A cast node can be formed from a single cast member or two or more cast members that are joined to form a node. A node typically consists of a structure with one or more connection points, e.g., arms or sockets, to which, for example, a cast, extruded, or sheet member can be connected by various joining techniques, such as by means of weld, adhesives, or mechanical devices. The frames and subframes can be assembled by adhesive or other bonding or by combinations of these and other joining techniques. An example of such a vehicle frame structure is available in U.S. Pat. No. 4,618,163, entitled "Automotive Chassis" the contents of which are incorporated herein by reference. This structural configuration for a vehicle frame is often referred to as a "space frame." Aluminum is a highly desirable metal for such vehicle frame constructions because of its light weight compared to a typical steel component and aluminum's energy absorption properties. Aluminum alloys also improve the vehicle's frame stiffness. More importantly, an aluminum vehicle frame demonstrates the strength and crash worthiness typically associated with much heavier, conventional steel frame vehicle designs. The lightweight aluminum vehicle frame also provides numerous environmental benefits and efficiencies through reduced fuel consumption and the opportunity ultimately to recycle the aluminum frame when the useful life of the vehicle is spent.

Conventional aluminum/magnesium casting alloys have many attractive properties, such as high ultimate tensile strength (>40 ksi) and elongation (>8%) with moderate yield strength (>16 ksi). However, in the preparation of component parts for automotive frame assemblies, sub assemblies, and components, it is desirable to have component parts characterized by higher elongations, while maintaining acceptable strength, stress-corrosion resistance, and other properties important to vehicle "space frame" applications. Prior to the instant invention, existing aluminum/magnesium alloys failed to exhibit the desired property requirements.

Current practice in the manufacture of automotive components used in a "space frame" structure as disclosed in the aforementioned U.S. Pat. No. 4,618,163 includes using aluminum/silicon casting alloys. One example of such an aluminum/silicon casting alloy is disclosed in U.S. Pat. No. 5,250,125, entitled "Process for Grain Refinement of Aluminum Casting Alloys, in Particular Aluminum/Silicon Casting Alloys" to Koch et al., the contents of which are incorporated herein by reference as if fully set forth. By way of an additional example, the assignee of the instant invention has previously disclosed in U.S. Pat. No. 5,076,344 entitled "Die Casting Process and Equipment," a casting alloy capable of meeting the requirements of the space frame cast nodes without the economic liability of expensive constituents. The use of aluminum/silicon alloys requires the post casting solution heat treatment, quenching, and aging of the cast component in order for the component to exhibit the desired mechanical properties. Unfortunately, solution heat treatment and quenching can often cause some degree of distortion to the cast component and the reworking of the cast component to correct heat treatment distortion is a time and labor intensive activity. Notwithstanding such efforts to develop alloys that offer the desired properties and characteristics, there remains a need for alloys that are cost effective and that are much less sensitive to heat treatment subsequent to the casting operation while meeting all of the property requirements described above.

It is an object of this invention to provide an aluminum/magnesium alloy ideally suited for use in die casting operations.

It is another object of the invention to provide an aluminum/magnesium alloy product characterized by the elimination of solution heat treatment.

It is also an object of this invention to provide an aluminum/magnesium alloy capable of an increased range of shapes and improved dimensional stability for use in the manufacture of aluminum intensive vehicles.

It is an object of this invention to provide improved cast products and components consisting of an improved aluminum/magnesium alloy cast members that ideally are suited for frames, subframes, and frame members in vehicle primary structures.

SUMMARY OF THE INVENTION

The above as well as other objects of this invention are achieved by way of the instant invention in which the alloy composition is formulated to contain about 2 to 5 wt. % magnesium, preferably about 2.5 to 4 wt. % magnesium, and preferably no more than 0.3 wt. % silicon, and about 0.2 to 1.6 wt. %, preferably about 0.4 to 0.8 wt. % manganese, and, with preferably no more than 1 wt. % iron, and between about 0.1 to 0.3 wt. %, preferably about 0.12 to 0.16 wt. %, zirconium, the balance substantially aluminum and incidental elements, such as zinc, and impurities. Unless indicated otherwise, all composition percentages set forth herein are by weight. This aluminum alloy eliminates the need for post casting solution heat treat and quenching operations. In fact, after casting, aging at low temperatures without solution heating and quenching is preferred, that is, at a temperature of between about 150 and 250 degrees centigrade, preferably, between about 175 to 225 degrees centigrade, for a period of time of between one (1) and eight (8) hours, preferably between about two (2) to four (4) hours. The alloy composition of this invention is therefore ideally suited for the improved post die casting processing, i.e., the elimination of conventional high temperature solution heat treating and high temperature aging, while providing even complexly shaped cast products characterized by improved dimensional stability and mechanical properties.

DETAILED DESCRIPTION OF THE INVENTION

In accordance with this invention, the alloy composition is formulated to contain about 2 to 5 wt. % magnesium, preferably about 2.5 to 4 wt. % magnesium, and about preferably no more than 0.3 wt. % silicon, and about 0.2 to 1.6 wt. %, preferably about 0.4 to 0.8 wt. % manganese, and, with preferably no more than 1 wt. % iron, and between about 0.1 to 0.3 wt. %, preferably about 0.12 to 0.16 wt. %, zirconium, the balance substantially aluminum and incidental elements and impurities. The alloy is typically solidified into ingot-derived stock by continuous casting or semi-continuous casting into a shape suitable for remelt for casting, which shape is typically an ingot billet.

In connection with the present invention, aluminum/magnesium casting alloys are understood as meaning aluminum casting alloys containing magnesium as the main alloying element. The concept of aluminum/magnesium casting alloys consequently also implies alloys containing further alloying elements, special additions, and commercial impurities, and comprises both primary and remelted alloys. Depending on the field of application, the magnesium content of aluminum/magnesium casting alloys is preferably between about 2 wt. % and 5 wt. %.

According to the instant invention, the aluminum/magnesium cast component does not require a solution heat treatment. For example, completed castings can be aged and then air cooled. Aging occurs at a temperature of between about 150 and 250 degrees centigrade, preferably, between about 175 and 225 degrees centigrade, preferably, about 200 degrees centigrade, for a period of time of between one (1) and eight (8) hours, preferably between about two (2) to four (4) hours. For example, cast alloy samples of the instant invention in a T5-temper demonstrate a high ultimate tensile strength (>30 ksi) and elongation (>13%) with yield strength (>17 ksi). It has been found that this aluminum/magnesium alloy according to the instant invention with an addition of zirconium and manganese, or simply with the addition of only manganese, has demonstrated significant levels of strength and elongation for many complex structural applications, especially for automotive frame components. The alloy demonstrates a high resistance to general corrosion and stress corrosion. For example, corrosion testing of the instant alloy by nitric-acid weight loss as a standard test method (ASTM G67-93) indicated a weight loss of only approximately 11.9 mg/cm$^2$. Components cast from this alloy demonstrate surprisingly high levels of weldability to common extrusion alloys as evidenced by the quality of the weld bond. It has been found that automotive frame components cast from this alloy exhibit high energy absorption without severe fracture. A sample cast product was subjected to compressive loading by means of a static axial crush test. During this test, a specified length of an energy absorbing component is compressively loaded at a predetermined rate creating a final deformed component height of approximately half the original free length or less. An ideal response for evaluation of energy absorbing components is stable collapse characterized by an absence of substantial fractures. Components of the alloy of this invention demonstrate acceptable performance with only minimal fracturing. Moreover, the instant aluminum-magnesium alloy is environmentally friendly and is readily recyclable because it does not contaminate the wrought alloy stream of recycled materials. Accordingly, there is less need to segregate cast members made according to the instant invention from the remainder of the recycled automobile aluminum components.

The composition of a sample product cast from the alloy composition of this invention is shown in Table I.

TABLE I

| Mg | Mn | Fe | Si | Zr | Zn |
|---|---|---|---|---|---|
| 2.94 | 0.65 | 0.26 | 0.07 | 0.12 | 0.01 |

In Table II, a sample of the alloy of this invention (Tab. I Sample) is compared to a commercial Al—Si alloy with about 10 wt. % Si (Commercial) with a -T6 temper that is employed in the production of cast components for automotive applications. The commercial Al—Si alloy is used to produce a cast product that includes a solution heat treatment and quenching operation.

TABLE II

| Alloy | Temper | TYS | UTS | Elongation | Fracture Toughness |
|---|---|---|---|---|---|
| Tab. I Sample | T5 | 116 MPa | 219 MPa | 19% | 1070 kJ/m$^2$ |
| Commercial | T6 | 120 Mpa | 191 Mpa | 17% | 611 kJ/m$^2$ |

As can be appreciated, the Al—Mg alloy of the instant invention produces a cast component that does not require the solution heat treat and quenching of conventional Al—Si alloys to obtain the desired mechanical properties and characteristics required for many applications, including for example, vehicle components.

Unless indicated otherwise, the following definitions apply herein:

a. Percentages for a composition are on a weight basis (wt. %).

b. In stating a numerical range or a minimum or a maximum for an element of a composition or a temperature or other process matter or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 2 to 5 discloses 2.0, 2.1, 2.2 . . . 2.9, 3, 3.1,3.2 . . . and so on, up to 5, including every number and fraction or decimal therewithin, and "up to 5" discloses 0.01 . . . 0.1 . . . 1 and so on up to 5.)

Having described the presently preferred embodiments for an improved casting alloy, it is to be understood that the invention may be otherwise embodied within the scope of the appended claims.

What is claimed is:

1. The method of producing an improved cast aluminum alloy product comprising: providing an alloy consisting of essentially of about 2 to 5 wt. % magnesium, up to approximately 0.3 wt. % silicon, approximately 0.2 to 1.6 wt. % manganese, up to approximately 0.60 wt. % iron, and between about 0.1 to 0.3 wt. %, zirconium, the balance substantially aluminum and incidental elements and impurities; and casting a body of said alloy.

2. The method according to claim 1 wherein the alloy contains about 2.5 to 4 wt. % magnesium.

3. The method according to claim 1 wherein the alloy contains less than about 0.3 wt. % silicon.

4. The method according to claim 1 wherein the alloy contains about 0.4 to 0.8 wt. % manganese.

5. The method according to claim 1 wherein the alloy contains about 0.12 to 0.16 wt. % zirconium.

6. The method according to claim 1 further comprising the alloy to a T5 temper so that said alloy has a high ultimate tensile strength greater than 30 ksi and elongation greater than 13% with yield strength greater than 17 ksi.

7. The method of producing an improved cast aluminum alloy product according to claim 1 wherein the cast product is a frame member in a vehicle.

8. A product whose production includes the method of claim 1.

9. In the production of a vehicular frame component wherein a cast component is produced by one or more operations into said frame component, the improvement wherein the production of said cast component includes:

providing an alloy consisting of essentially of about 2 to 5 wt. % magnesium, up to approximately 0.3 wt. % silicon, approximately 0.2 to 1.6 wt. % manganese, up to approximately 0.60 wt. % iron, and between about 0.1 to 0.3 wt. %, zirconium, the balance substantially aluminum and incidental elements and impurities; and casting said frame component from said alloy.

10. A vehicle frame comprising cast components that are joined together or joined with wrought components to make a frame or subframe, at least one of said cast components is an aluminum alloy consisting essentially of about 2 to 5 wt. % magnesium, up to approximately 0.3 wt. % silicon, approximately 0.2 to 1.6 wt. % manganese, up to approximately 0.60 wt. % iron, and between about 0.1 to 0.3 wt. %, zirconium, the balance aluminum and incidental elements and impurities.

11. The method of producing an improved cast aluminum alloy product comprising: providing an alloy consisting of essentially of about 2 to 5 wt. % magnesium, up to approximately 0.3 wt. % silicon, approximately 0.2 to 1.6 wt. % manganese, up to approximately 1 wt. % iron, and between about 0.1 to 0.3 wt. %, zirconium, the balance substantially aluminum and incidental elements and impurities; casting a body of said alloy; and aging said cast body at a temperature of between about 150 to 250 degrees centigrade for between about 1 to 8 hours.

12. The method of producing an improved cast aluminum alloy product according to claim 11 wherein the aging is conducted at a temperature of about 200 degrees centigrade.

13. The method of producing an improved cast aluminum alloy product according to claim 11 wherein the aging is conducted for between 2 to 4 hours.

14. The method of producing an improved cast aluminum alloy product according to claim 11 wherein the aging is conducted at a temperature of about 200 degrees for at least one hour.

15. The method according to claim 11 wherein the alloy contains about 2.5 to 4 wt. % magnesium.

16. The method according to claim 11 wherein the alloy contains less than about 0.3 wt. % silicon.

17. The method according to claim 11 wherein the alloy contains about 0.4 to 0.8 wt. % manganese.

18. The method according to claim 11 wherein the alloy contains about 0.12 to 0.16 wt. % zirconium.

19. The method according to claim 11 aging is conducted so that the alloy is at a T5 temper and has a high ultimate tensile strength greater than 30 ksi and elongation greater than 13% with yield strength greater than 17 ksi.

20. The method of producing an improved cast aluminum alloy product according to claim 11 wherein the cast product is a frame member in a vehicle.

21. A product whose production includes the method of claim 11.

22. A product whose production includes the method of claim 12.

23. A product whose production includes the method of claim 13.

24. The method of producing an improved cast aluminum alloy product comprising: providing an alloy consisting of essentially of about 2.5 to 4 wt. % magnesium, up to approximately 0.3 wt. % silicon, approximately 0.4 to 0.8 wt. % manganese, up to approximately 0.60 wt. % iron, and between about 0.12 to 0.16 wt. %, zirconium, the balance substantially aluminum and incidental elements and impurities; and casting a component of said alloy.

25. An improved aluminum alloy for casting operations consisting essentially of about 2 to 5 wt. % magnesium, up to approximately 0.3 wt. % silicon, approximately 0.2 to 1.6 wt. % manganese, up to approximately 0.60 wt. % iron, and between about 0.1 to 0.3 wt. %, zirconium, the balance substantially aluminum and incidental elements and impurities.

26. The improved aluminum alloy according to claim 25 wherein the alloy contains about 2.5 to 4.0 wt. % magnesium.

27. The improved aluminum alloy according to claim 25 wherein the alloy contains about 0.4 to 0.8 wt. % manganese.

28. The improved aluminum alloy according to claim 25 wherein the alloy contains about 0.12 to 0.16 wt. % zirconium.

29. The improved aluminum alloy according to claim 25 wherein the alloy is capable of being aged to a T5 temper, said alloy at said temper having a high ultimate tensile strength greater than 30 ksi and elongation greater than 13% with yield strength greater than 17 ksi.

* * * * *

UNITED STATES PATENT AND TRADEMARK OFFICE

CERTIFICATE OF CORRECTION

PATENT NO. : 5,667,602

DATED : September 16, 1997

INVENTOR(S) : Que-Tsang Fang et al.

It is certified that error appears in the above-identified patent and that said Letters Patent is hereby corrected as shown below:

| | |
|---|---|
| Col. 6, line 1 | After "claim 11", insert --wherein the-- |
| Col. 4, line 58 | After "comprising", insert --aging-- |

Signed and Sealed this

Seventeenth Day of February, 1998

Bruce Lehman

*Attest:*

BRUCE LEHMAN

*Attesting Officer*

*Commissioner of Patents and Trademarks*